US008998019B2

(12) United States Patent
Ingersoll

(10) Patent No.: US 8,998,019 B2
(45) Date of Patent: Apr. 7, 2015

(54) BAGGAGE SYSTEM AND RELATED METHODS

(71) Applicant: Greg Ingersoll, Midvale, UT (US)

(72) Inventor: Greg Ingersoll, Midvale, UT (US)

( * ) Notice: Subject to any disclaimer, the term of this patent is extended or adjusted under 35 U.S.C. 154(b) by 0 days.

(21) Appl. No.: 14/032,771

(22) Filed: Sep. 20, 2013

(65) Prior Publication Data

US 2015/0001224 A1 Jan. 1, 2015

Related U.S. Application Data

(60) Provisional application No. 61/703,393, filed on Sep. 20, 2012.

(51) Int. Cl.
*B65F 1/06* (2006.01)

(52) U.S. Cl.
CPC ..... *B65F 1/062* (2013.01)

(58) Field of Classification Search
USPC ..... 220/495.07, 480, 481, 495.06; 206/554
See application file for complete search history.

(56) References Cited

U.S. PATENT DOCUMENTS

| | | | | |
|---|---|---|---|---|
| 2,725,141 | A * | 11/1955 | Latvala et al. | 206/554 |
| 2,916,183 | A * | 12/1959 | Ariens | 220/495.07 |
| 4,363,405 | A * | 12/1982 | Christie | 206/774 |
| 4,923,087 | A | 5/1990 | Burrows | |
| 5,450,964 | A * | 9/1995 | Miller | 206/554 |
| 5,803,299 | A * | 9/1998 | Sealy, Jr. | 220/495.07 |
| 6,374,577 | B1 * | 4/2002 | Ventura | 53/390 |
| 6,824,005 | B1 * | 11/2004 | Ashinhurst | 220/495.07 |
| 8,016,111 | B2 * | 9/2011 | Wilson et al. | 206/554 |
| 2004/0262316 | A1 | 12/2004 | Diep | |
| 2007/0235456 | A1 | 10/2007 | Tamez | |

FOREIGN PATENT DOCUMENTS

| | | | |
|---|---|---|---|
| CN | 201154827 | Y | 11/2008 |

* cited by examiner

*Primary Examiner* — Stephen Castellano
(74) *Attorney, Agent, or Firm* — Thorpe North & Western, LLP

(57) ABSTRACT

A system for storing bags adjacent to or within a container with which the bags will be used includes a bag bundle holding assembly, attached to or held adjacent the container and a bag bundle. The bag bundle includes a plurality of bags held in a bundle. The bag bundle is removably coupleable to the holding assembly adjacent to or within the container.

9 Claims, 9 Drawing Sheets

BAGGAGE SYSTEM AND RELATED METHODS

PRIORITY CLAIM

This application claims benefit of and priority to U.S. Provisional Patent Application Ser. No. 61/703,393, filed Sep. 20, 2012, which is hereby incorporated herein by reference in its entirety.

BACKGROUND OF THE INVENTION

1. Field of the Invention

The present invention relates generally to the field of baggage systems. More particularly, the present invention relates to baggage systems for use in processing waste materials, usable goods and the like.

2. Related Art

Bags and related containers used to collect trash, recyclables and the like have been provided in a myriad of configurations. The bags are typically used to line a container to both limit contamination of the container, and to provide a means by which the trash or other items can be carried away from the container. Very often, container sizes and shapes vary such that bags or liners provided for use in such containers must also be provided in a variety of sizes and shapes.

While it is generally relatively simple to remove a bag from a container, it is oftentimes difficult to find a replacement bag for any particular container, as the replacement bags may be stored in a location remote from the container. A person wishing to change the bag in a container must generally first find the proper replacement bag, and carry the replacement to the container. In many public buildings, such as commercial offices, churches and the like, persons using the buildings may not have access to locations where replacement bags are stored. Thus, while such personnel may empty garbage can liners and the like, they may not be able to replenish the liner after doing so.

SUMMARY OF THE INVENTION

In accordance with one aspect of the invention, a system for storing bags adjacent to or within a container with which the bags will be used is provided, including a bag bundle holding assembly, attached to or held adjacent the container. A bag bundle can comprise a plurality of bags held in a bundle. The bag bundle can be removably coupleable to the holding assembly adjacent to or within the container.

In accordance with another aspect of the invention, a bag bundle for use with a system for providing storage bags for a container is provided. The bag bundle can include a plurality of bags bundled one with another to form a bag bundle mass. The bag bundle mass can have one or more openings formed therein to engage a holding assembly carried by a container within which each of the plurality of bags is sized and shaped to be installed.

In accordance with another aspect of the invention, a method of storing a plurality of bags each of which is to be used successively within a container is provided, including positioning a bag bundle within a container; engaging a holding assembly with the bag bundle such that the holding assembly suspends the bag bundle within the container; removing a bag from the bag bundle and positioning an upper portion of the bag about an upper perimeter of the container; and positioning a bottom portion of the bag within a bottom portion of the container such that the bag collects items placed into the container.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
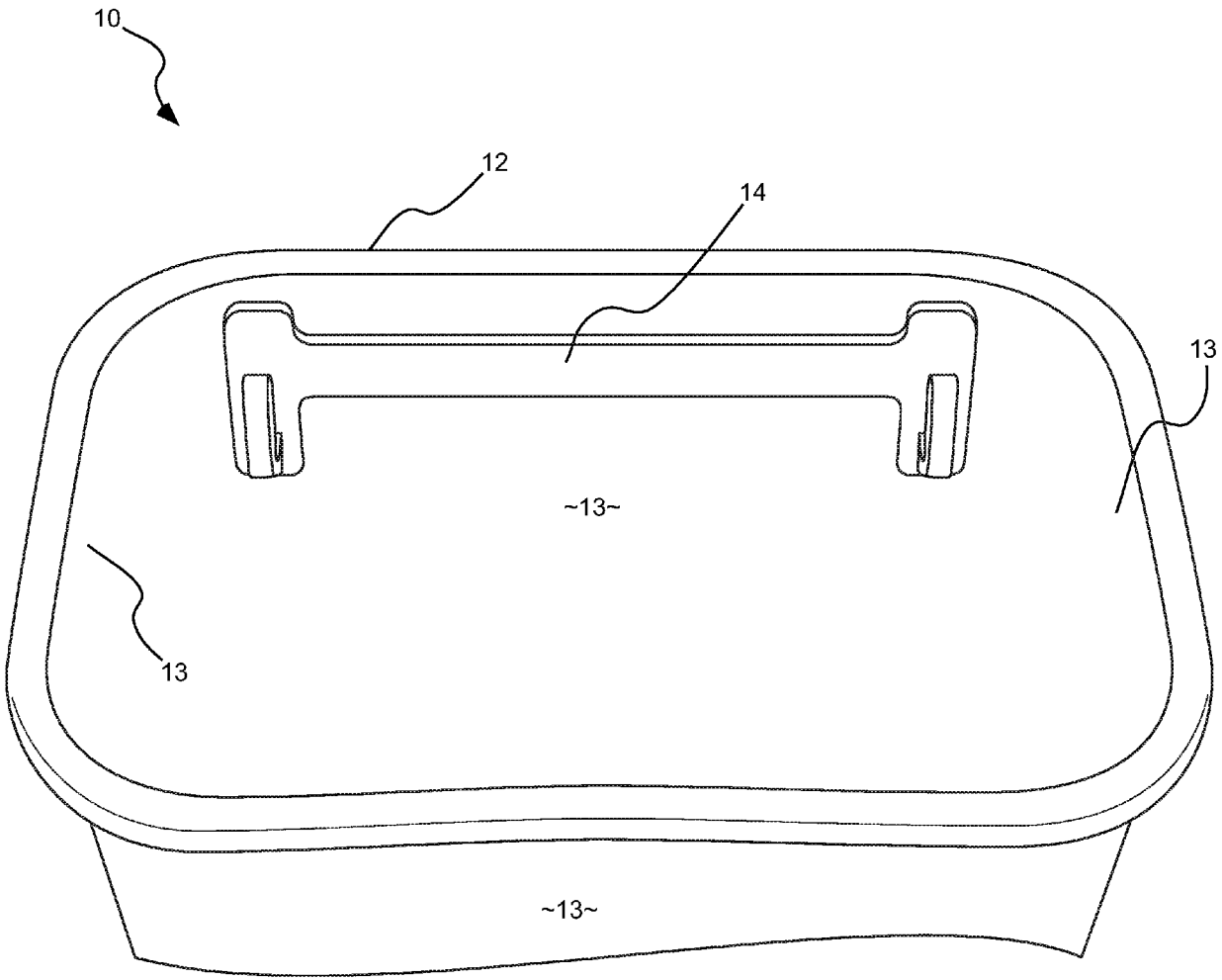
FIG. 1 is a front, top perspective view of a container having a bag bundle holding assembly attached therein in accordance with an embodiment of the invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

DEFINITIONS

As used herein, the singular forms "a" and "the" can include plural referents unless the context clearly dictates otherwise. Thus, for example, reference to "a bag bundle" can include one or more of such bag bundles.

Directional terms are sometimes used herein to describe and claim various aspects of the technology. Examples include, without limitation, "top," "bottom," "upper", "lower," etc. Except where specifically claimed, such terms are not to be intended to limit the invention. Such terms are used in a manner consistent with the understanding of one of ordinary skill in the art.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

Figure 3:
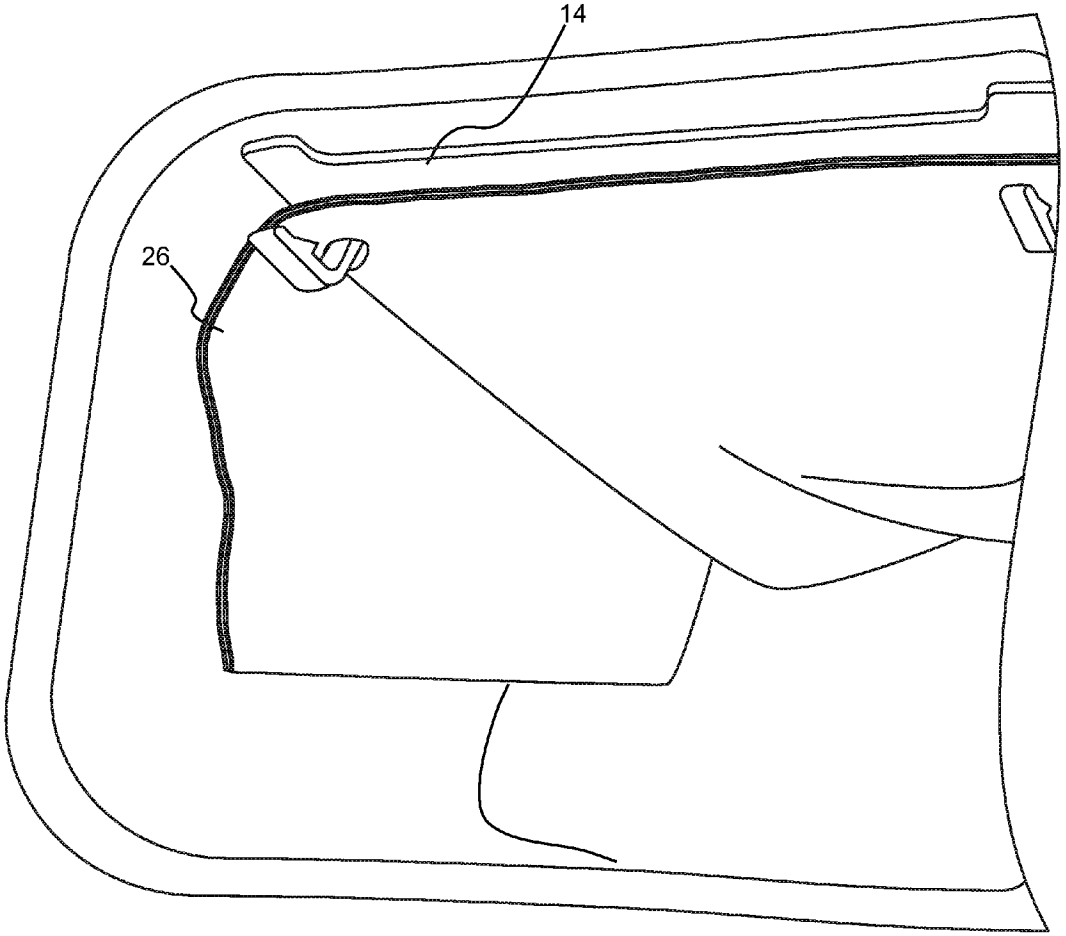
FIG. 3 is a partial, top perspective view of the container and holding assembly of FIG. 1, with a bag bundle installed on the holding assembly.

The present invention relates to systems and methods for conveniently storing bags adjacent to, or within, containers designed to accept refuge such as garbage and recycling materials, usable items to be stored and/or transported, and the like. As shown by example in FIGS. 1 and 3, the system 10 typically includes a container 12 and a bag bundle holding assembly 14 (sometimes referred to herein simply as the "holding assembly"). The holding assembly 14 can be associated with the container in a variety of manners, as will be discussed in more detail below. A bag bundle 26 can be configured to be engaged by the holding assembly such that the bag bundle can be suspended within the container.

Thus, once properly installed, the system provides a convenient method by which bags or liners configured for use with containers can be stored with the container. In this manner, finding a replacement bag or liner that is properly sized and shaped for any particular container can be easily accomplished. The types of containers 12 with which the present invention can be utilized can vary widely (e.g., containers designed for indoor use, outdoor use, office use, manufacturing applications, etc.), as can the shape (e.g., cylindrical or square). Similarly, the bags that can be provided in the bag bundle 26 can vary: they can be of a multitude of sizes of shapes and can, for example, include drawstring handles, "butterfly" handles, no handles, etc. The present system can thus be adapted for use in residential settings, industrial settings, commercial settings, public settings, etc.

As shown specifically in FIGS. 1 and 2A through 2D, in one aspect of the invention, the bag bundle holding assembly 14 can be formed as a generally elongate strip of material. The holding assembly can include a base 18 that extends between a pair of end sections 20. While not so required, the end sections can extend outwardly from the base so as to present a larger height dimension than does the base. Each of a pair of support prongs 22 can extend from the end sections to present a holding interface with which a bag bundle 26 can cooperate. In the example shown, the bag bundle can include a pair of openings (29 in FIGS. 7 and 9) formed therein: the support prongs can be inserted through the openings to allow the bag bundle to be suspended by the support assembly 14.

In one aspect of the invention, the support assembly 14 can be formed of a flexible strip of material to allow the support assembly to conform to a contour of an inner portion of a container. This aspect of the invention can be advantageous, as many trash containers include curved or rounded walls. The support assembly can be bonded or adhered to the curved or rounded wall of a container without protruding unnecessarily into the usable space of the container. Commonly known adhesives, adhesive tapes, plastic welding, etc., can be used to adhere the support assembly to the inner confines of the container. In one aspect of the invention, the support assembly can be formed integrally with the container. Also, while not shown in detail, a support assembly that includes one or more hooks can be used, with the hooks engaging an upper portion of the container such that the support assembly is suspended from the upper edge of the container by the hooks. Such a configuration is shown in detail in the provisional patent application to which the present application claims priority.

The flexible nature of the strip or base 18 (and the holding assembly 14 generally) can be such that the support prongs 22 still provide sufficient support to the bag bundle 26 such that the bag bundle is suspended within the container. The base 18 can be formed from a variety of materials, including polymers, metallic materials, etc. While not so limited, in one aspect of the invention, the support prongs 22 are spaced about 10 inches from one another, with an overall height of the end sections 20 being about 3 inches, and a width of the end sections being about 1 inch. The support prongs can extend outwardly from the end sections about 1¼ inches and can have a height of about 2½ inches. The central portion of the base can be about 1 inch in height. The thickness of the base can be about ⅛ of an inch.

Figure 2A:
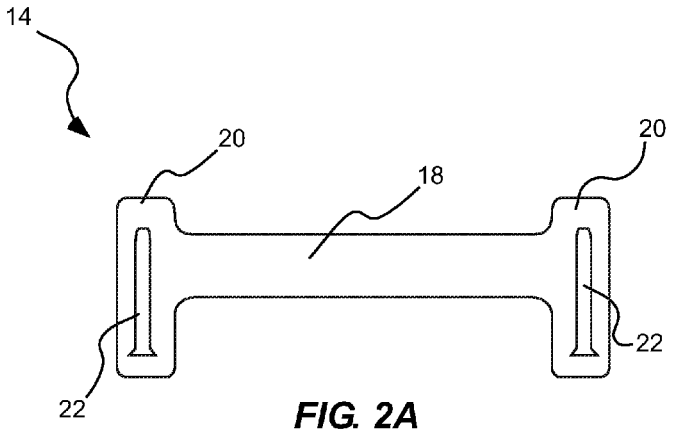
FIG. 2A is a front view of a bag bundle holding assembly in accordance with an embodiment of the invention.
Figure 2C:
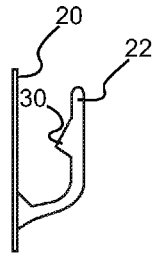
FIG. 2C is a side view of the bag bundle holding assembly of FIG. 2A.
Figure 2B:
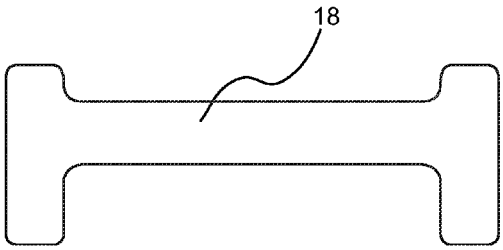
FIG. 2B is a rear view of the bag bundle holding assembly of FIG. 2A.
Figure 2D:
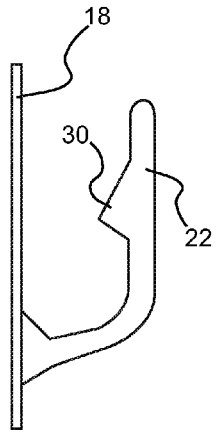
FIG. 2D is an enlarged side view of the bag bundle holding assembly of FIG. 2A.
Figure 4:
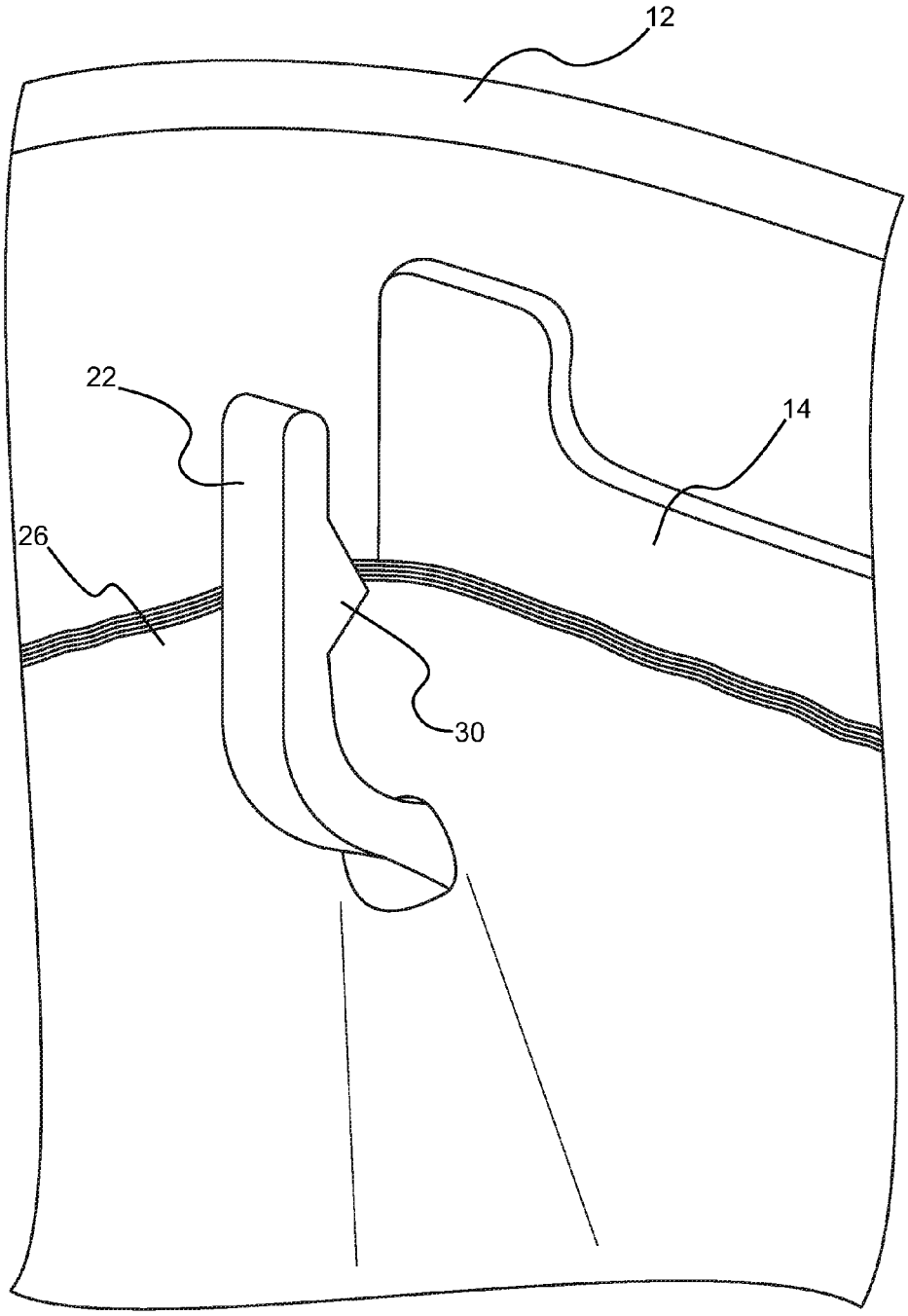
FIG. 4 is an enlarged view of a support prong of the holding assembly of FIG. 1.

As best shown in FIGS. 2C, 2D and 4, in one aspect of the invention a retaining portion 30 can be associated with the support prong(s) 22. The retaining portion can serve to resist or prevent movement of the bag bundle 26 relative to the at least one support prong. This can aid in maintaining the bag bundle in position on the support prong while one or more bags are removed from the bag bundle. The bag bundle can also be maintained in position if the container is moved, tipped over, etc.

Figure 8:
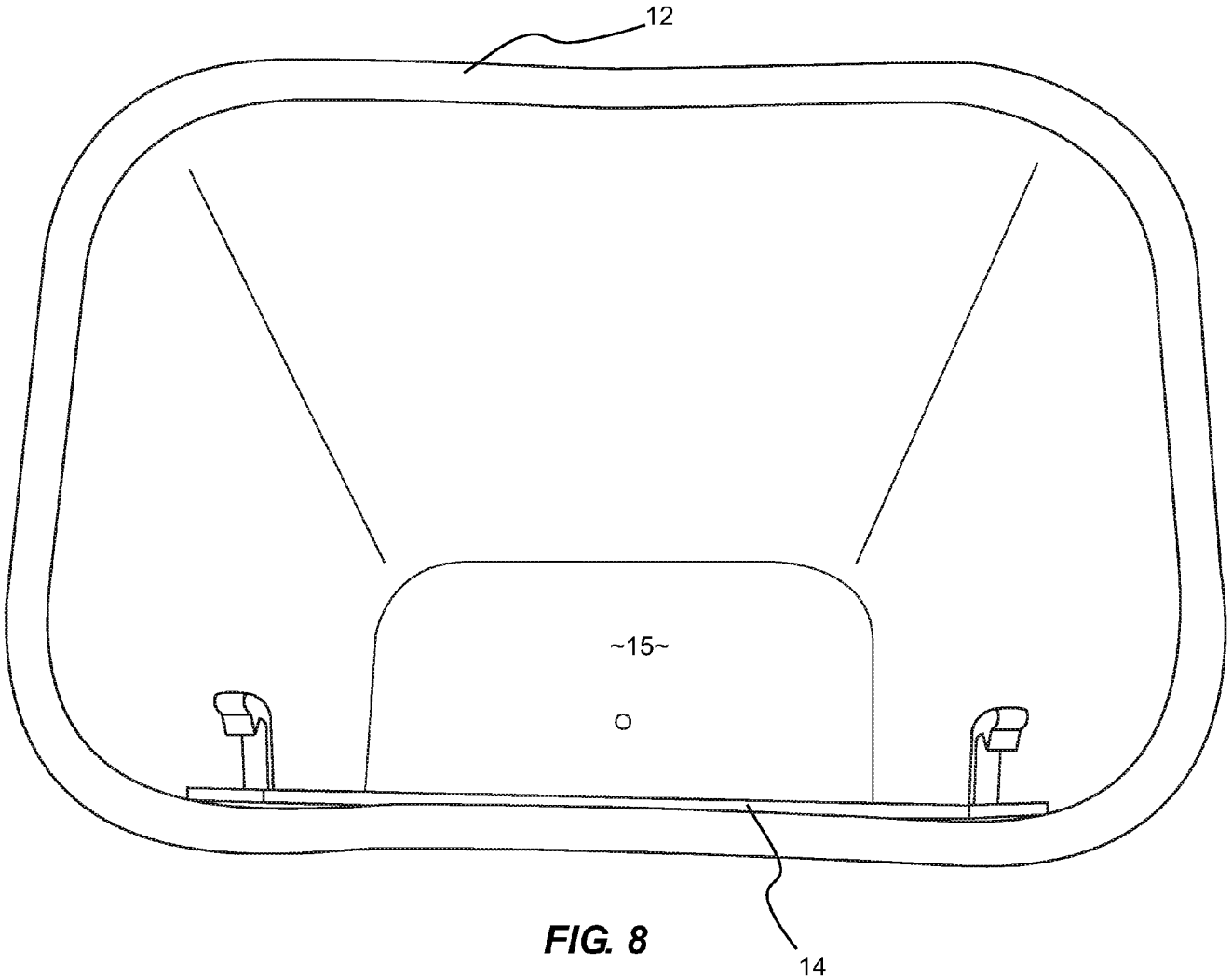
FIG. 8 is a top perspective view the container and bag bundle holding assembly of FIG. 1.

The types of container 12 with which the present system can be used can vary widely. For example, a container with a rectangular cross sectional shape is shown in the figures. In this case, the container will include four containment walls 13 (FIG. 1) and a bottom section (15 in FIG. 8). In some aspects, however, the container is a rounded, cylindrical container, in which case only one containment wall will encircle the bottom section. The flexibility of the support assembly 14 can greatly aid in adapting the present system for use in a wide range of container types. Also, while a container lid is not shown in the attached figures, the present system is well suited for use in containers that include lids, as the support assembly can be mounted within the container in a location that does not interfere with attachment of a lid to the container. In some aspects, the support assembly, and the bag bundle carried by the assembly, can be contained completely below an upper perimeter of the container.

Figure 9:
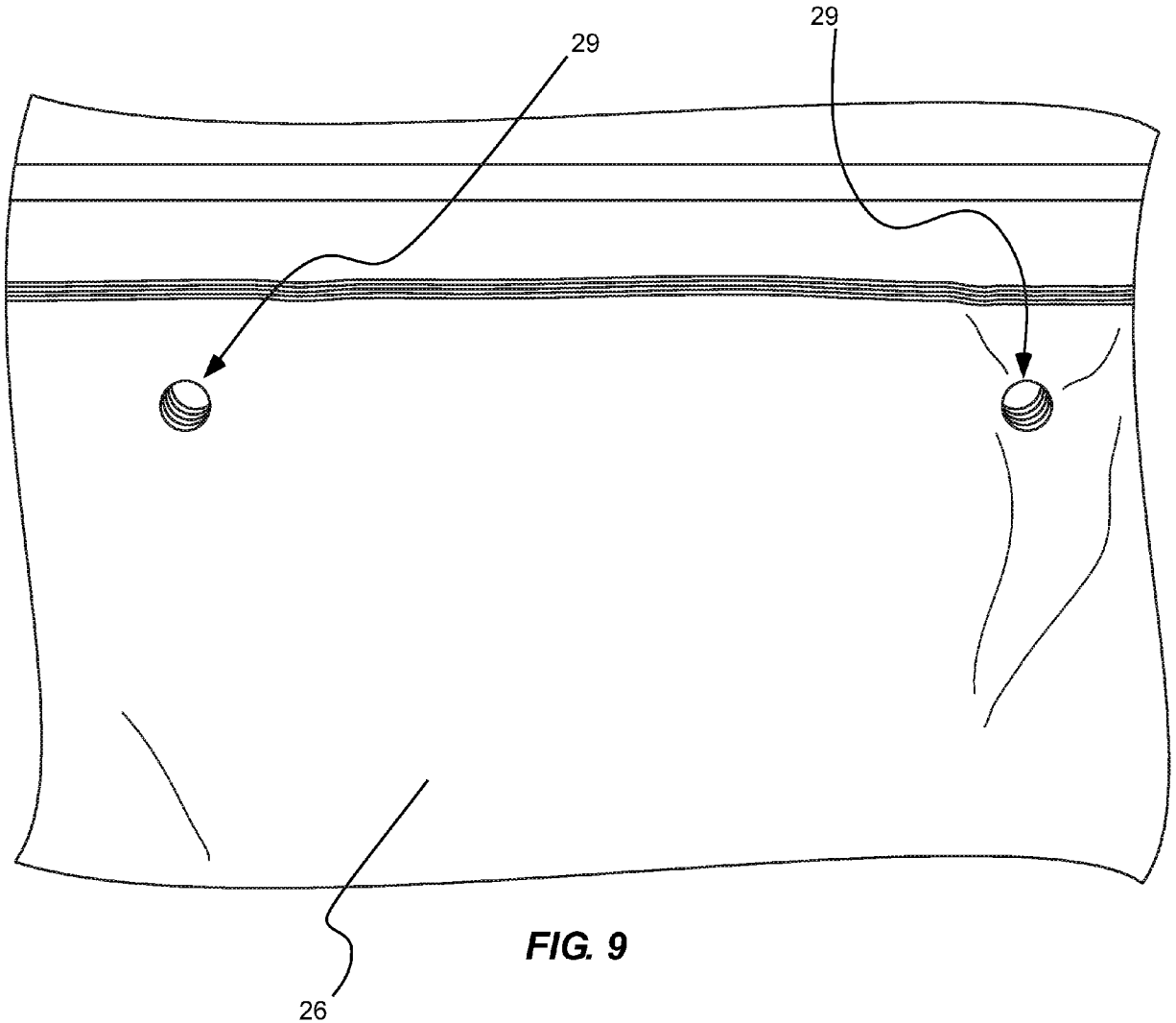
FIG. 9 is a partial view of a bag bundle in accordance with an aspect of the invention.

The bag bundle 26 can take a variety of forms. However, it is generally comprised of a series of bags suitable in dimension to be used with the container with which the system is intended for. Typically, a plurality of individual bags or liners (one such is shown at 24 in FIGS. 5, 6 and 7) are bundled into a unit 26 to facilitate ease of storage, transport and suspension from the support assembly 14. As best shown in FIG. 9, this results in a bag bundle that can be easily manipulated, stored, stacked one upon another, boxed and shipped, etc.

Each of the bags can be at least partially bonded one to another to ensure that the bundle remains intact during transport and use. The individual bags can be secured to one another in a variety of manners: they can be held together with an adhesive (much like the pages of a notebook), they can be plastically welded to one another, stitched together, etc. However the bundle is bonded, generally speaking each bag can be removed from the bag bundle without damaging the individual bag or the bundle as a whole. The bags can be formed of polymers, cloth and the like. In some aspects, a biodegradable bag can also be used, which can be beneficial to the environment.

Figure 5:
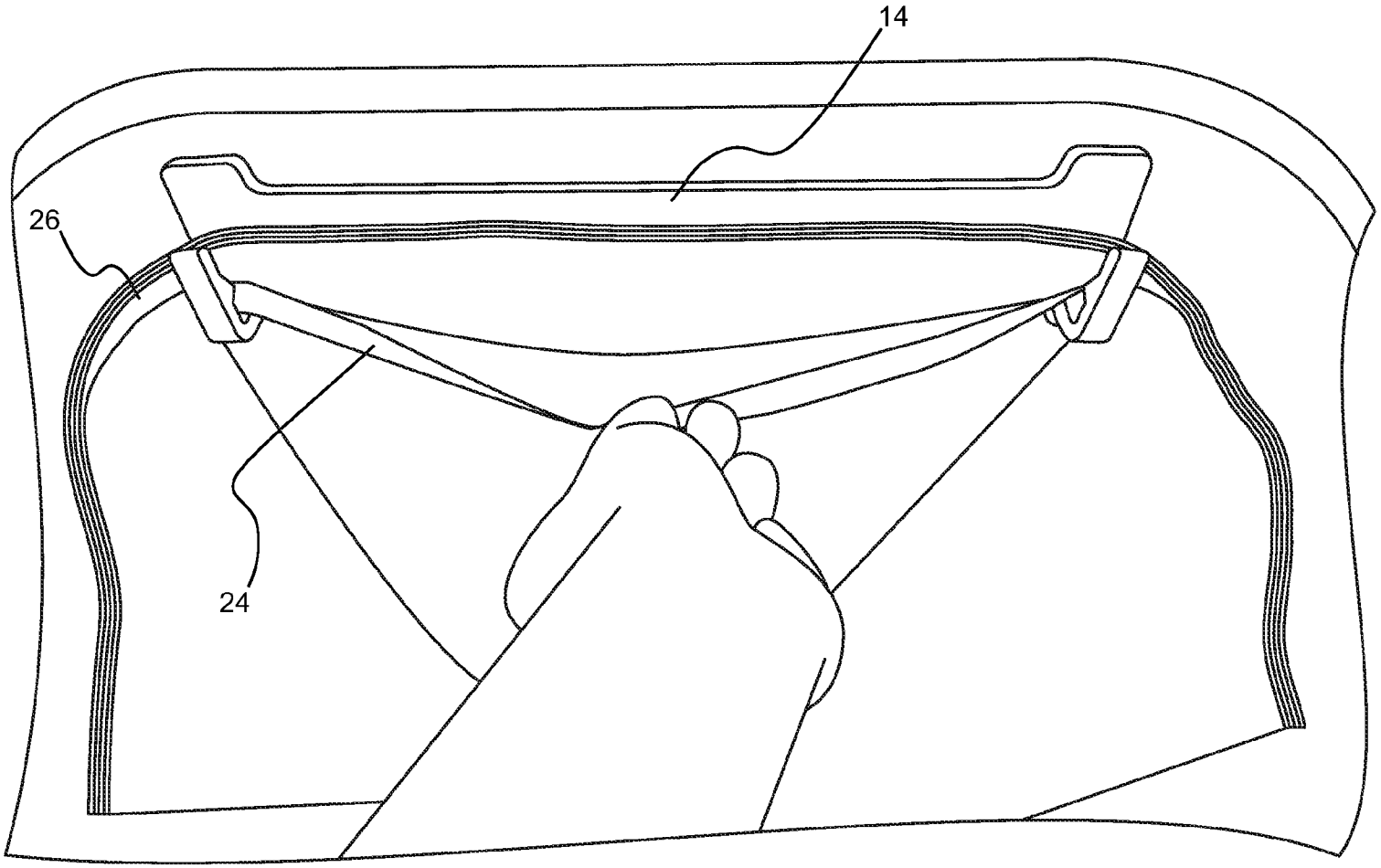
FIG. 5 is a top perspective view of the container and bag bundle holding assembly of FIG. 1, with a bag bundle installed therein and with a top bag being removed from the bundle.
Figure 6:
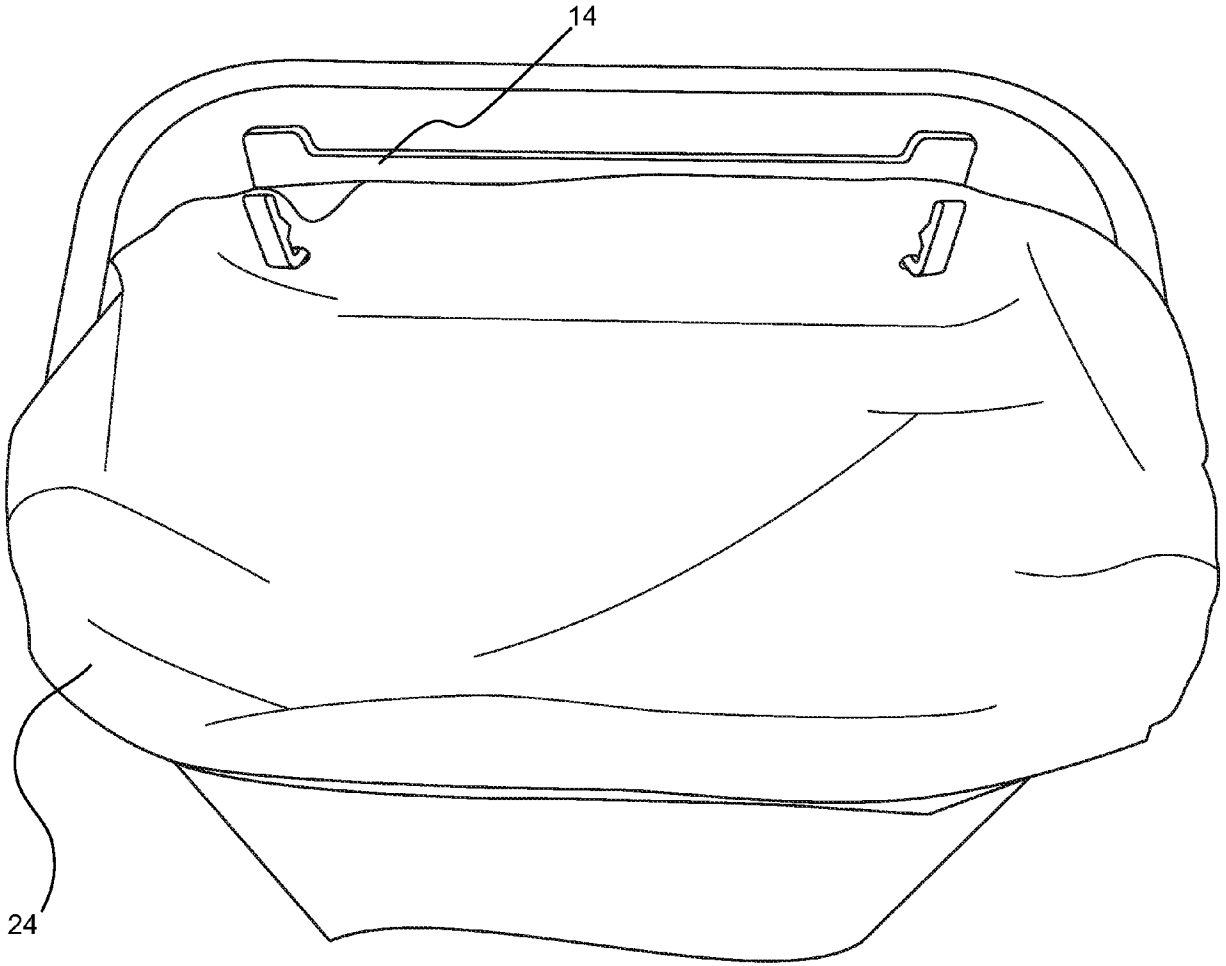
FIG. 6 is a perspective view of the assembly of FIG. 5, showing the top bag partially installed about an upper portion of the container.
Figure 7:
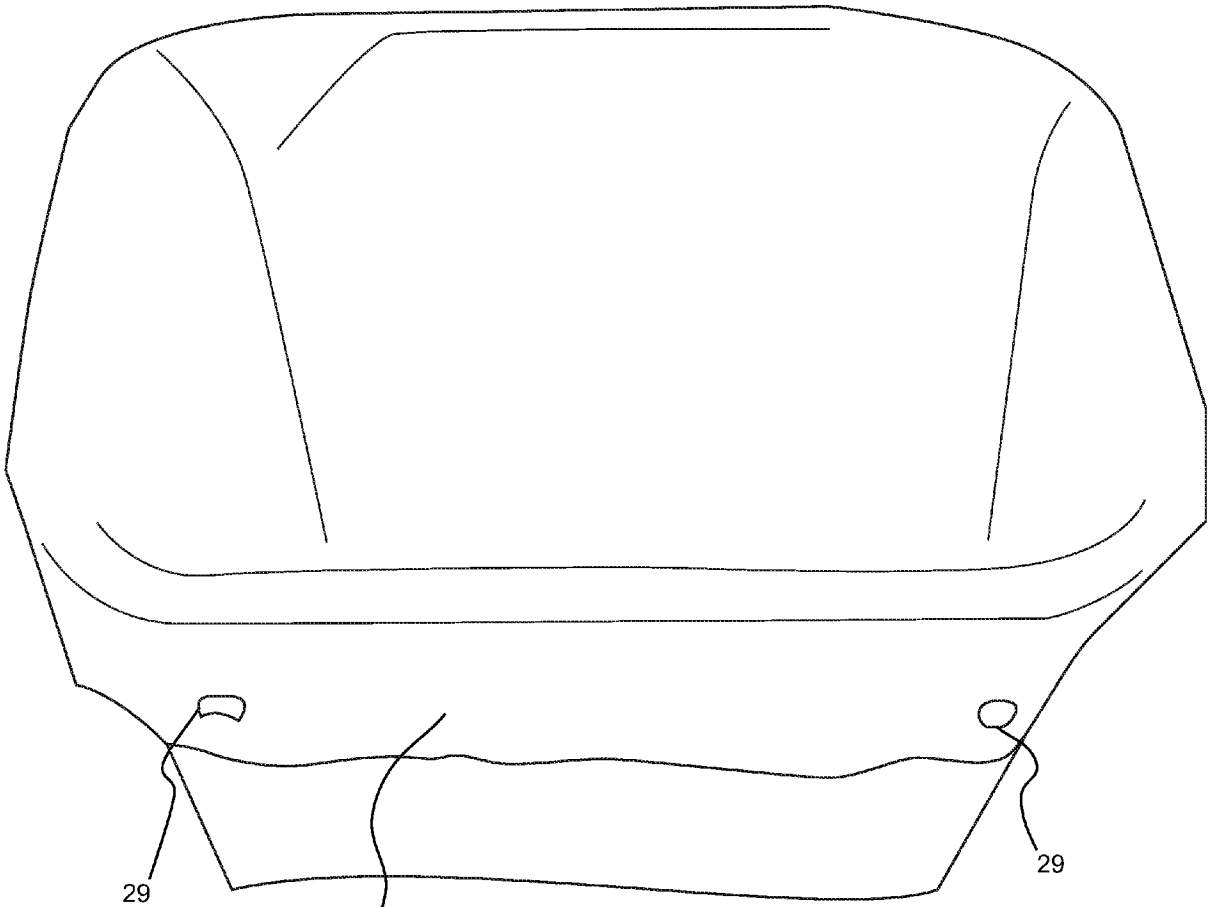
FIG. 7 is a perspective view of the assembly of FIG. 5, showing the top bag completely installed about the upper portion of the container.

FIGS. 5 through 7 illustrate one exemplary manner by which the present invention can be used to provide a bag or liner for use in a container. In FIG. 5, bag bundle 26 is shown installed on support assembly 14. A single bag 24 is shown being partially separated from the remainder of the bag bundle. In FIG. 6, the individual bag 24 is partially installed about an upper perimeter of the container, with a portion of the individual bag still secured to the support assembly 14. In FIG. 7, the individual bag 24 has been completely separated from the bag bundle and installed completely about the upper perimeter of the container and is in place and ready for use. As will be appreciated from this view, the bag bundle and support assembly are not visible beneath the individual bag 24, and only slightly, if at all, interfere with normal operation of the container.

In addition to the apparatus outlined above, the present technology also provides a method of storing a plurality of bags, each of which is to be used successively within a container. The method can include positioning a bag bundle within a container, and engaging a holding assembly with the bag bundle such that the holding assembly suspends the bag bundle within the container. A bag can be removed from the bag bundle, and an upper portion of the bag can be positioned about an upper perimeter of the container. A bottom portion of the bag can be positioned within a bottom portion of the container such that the bag collects items placed into the container.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

I claim:

1. A system for storing bags adjacent to or within a container with which the bags will be used, comprising:

a container having at least one containment wall coupled to a bottom wall;

a bag bundle holding assembly, coupleable inside the at least one containment wall, the bag bundle holding assembly including a base member and at least two support prongs extending therefrom; and a bag bundle comprising a plurality of bags held in a bundle, the bag bundle being removably coupleable to the holding assembly within the container;

the bag bundle holding assembly being selectively positionable by a user on the at least one containment wall such that the bag bundle holding assembly and the bag bundle are positionable on the at least one containment wall completely beneath an upper perimeter of the container; wherein at least one of the support prongs includes a retaining portion associated therewith, the retaining portion configured to resist movement of the bag bundle from the at least one support prong to maintain the bag bundle in position on the support prong while one or more bags are removed from the bag bundle, the retaining portion comprising a raised portion positioned at a midpoint of the at least one support prong.

2. The system of claim 1, wherein the container comprises a trash bin.

3. The system of claim 2, wherein the containment wall substantially completely circumscribes the bottom wall to form a trash bin closed on all sides except a top opening.

4. The system of claim 2, wherein an outer contour of the bags of the bag bundle is sized and shaped to correspond to an inner contour of the trash bin.

5. The system of claim 1, wherein the bag bundle holding assembly includes at least two support prongs extending therefrom, and wherein the bag bundle includes at least two openings formed therein, the prongs of the bag bundle holding assembly being engageable with the openings in the bag bundle to secure the bag bundle to the container.

6. The system of claim 1, wherein the base member is formed from a flexible material so as to be conformable to an inside contour of the at least one containment wall.

7. The system of claim 1, wherein the bag bundle holding assembly is selectively positionable by a user relative to a height of the at least one containment wall.

8. A system for storing bags adjacent to or within a container with which the bags will be used, comprising:

a container having at least one containment wall coupled to a bottom wall;

a bag bundle holding assembly, coupleable inside the at least one containment wall, the bag bundle holding assembly including a base and at least two support prongs extending from the base, the base being formed of a flexible material so as to be conformable to an inside contour of the at least one containment wall; and a bag bundle comprising a plurality of bags held in a bundle, the bag bundle being removably coupleable to the holding assembly within the container, the bag bundle holding assembly being selectively positionable by a user on the at least one containment wall such that the bag bundle holding assembly and the bag bundle are positionable on the at least one containment wall completely beneath an upper perimeter of the at least one containment wall; wherein at least one of the support prongs includes a retaining portion associated therewith, the retaining portion configured to resist movement of the bag bundle from the at least one support prong to maintain the bag bundle in position on the support prong while one or more bags are removed from the bag bundle, the retaining portion comprising a raised portion positioned at a midpoint of the at least one support prong.

9. The system of claim 8, wherein the bag bundle holding assembly is coupleable only to a single wall of the container.

* * * * *